United States Patent [19]

Petitpierre

[11] 4,025,090

[45] May 24, 1977

[54] PRESSURE-SENSITIVE OR HEAT-SENSITIVE RECORDING MATERIAL

[75] Inventor: Jean-Claude Petitpierre, Kaiseraugst, Switzerland

[73] Assignee: Ciba-Geigy Corporation, Ardsley, N.Y.

[22] Filed: Sept. 9, 1976

[21] Appl. No.: 721,916

[30] Foreign Application Priority Data

Oct. 8, 1975 Switzerland ..... 13070/75

[52] U.S. Cl. ..... 282/27.5; 260/240 A; 260/240.4; 260/240.7; 427/151; 428/323; 428/411; 428/913; 428/914

[51] Int. Cl.[2] ..... B41M 5/22

[58] Field of Search ... 282/27.5; 427/146, 150–153; 428/323, 326, 327, 411, 537, 913, 914; 260/240.4, 240.7, 240 A

[56] References Cited

UNITED STATES PATENTS 3,449,335 6/1969 Copeland ..... 260/240.4

FOREIGN PATENTS OR APPLICATIONS 2,157,094 5/1972 Germany ..... 427/150

*Primary Examiner*—Thomas J. Herbert, Jr.
*Assistant Examiner*—Bruce H. Hess
*Attorney, Agent, or Firm*—Karl F. Jorda; Edward McC. Roberts; Michael W. Glynn

[57] ABSTRACT

A pressure-sensitive or heat-sensitive recording material which contains as color former at least one tetrahydroquinoline compound of the general formula

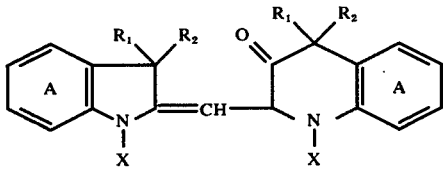

wherein each of $R_1$ and $R_2$ represents lower alkyl, cycloalkyl or benzyl or together represent alkylene, and X represents alkyl of at most 12 carbon atoms which is unsubstituted or substituted by halogen, hydroxyl, cyano, lower alkoxy or lower alkoxycarbonyl, or benzyl which is unsubstituted or substituted by halogen, nitro, lower alkyl or lower alkoxy, and the rings A can be substituted by halogen, nitro, cyano, trifluoromethyl, lower alkyl, lower alkoxy, lower alkoxycarbonyl, phenyloxy, amino, lower alkylamino or N-lower alkylcarbonylamino.

15 Claims, No Drawings

PRESSURE-SENSITIVE OR HEAT-SENSITIVE RECORDING MATERIAL

The present invention provides a pressure-sensitive or heat-sensitive recording material which contains as colour former in its colour-forming system at least one tetrahydroquinoline compound of the general formula

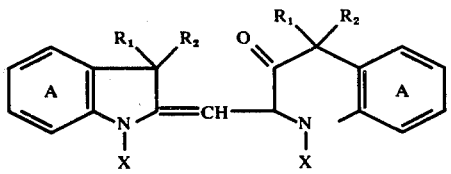

(1)

wherein each of $R_1$ and $R_2$ represents lower alkyl, cycloalkyl or benzyl or together represent alkylene, and X represents alkyl of at most 12 carbon atoms which is unsubstituted or substituted by halogen, hydroxyl, cyano, lower alkoxy or lower alkoxycarbonyl, or benzyl which is unsubstituted or substituted by halogen, nitro, lower alkyl or lower alkoxy, and the rings A can be substituted by halogen, nitro, cyano, trifluoromethyl, lower alkyl, lower alkoxy, lower alkoxycarbonyl, phenyloxy, amino, lower alkylamino or N-lower alkylcarbonylamino.

In the definition of the radicals of the tetrahydroquinoline compounds, lower alkyl and lower alkoxy normally represent those groups or moieties which contain 1 to 5, in particular 1 to 3, carbon atoms, for example methyl, ethyl, n-propyl, iso-propyl, n-butyl, sec. butyl or amyl, and methoxy, ethoxy or iso-propoxy.

Cycloalkyl groups represented by $R_1$ and $R_2$ are cyclopentyl or preferably cyclohexyl groups.

The radicals $R_1$ and $R_2$ can be different or preferably they are the same.

$R_1$ and $R_2$ preferably represent lower alkyl and most preferably both are methyl. Where $R_1$ and $R_2$ together represent alkylene, they advantageously contain 4 or 5 carbon atoms and with the carbon atom to which they are attached form a cyclopentane or cyclohexane ring.

Alkyl groups represented by the N-substituents X can be straight-chain or branched. Examples of such alkyl groups are: methyl, ethyl, n-propyl, iso-propyl, n-butyl, sec. butyl, n-hexyl, n-octyl or n-dodecyl.

Substituted alkyl groups in the definition of X are chiefly: cyanoalkyl, haloalkyl, hydroxyalkyl, each containing 2 to 4 carbon atoms, for example β-cyanoethyl, β-chloroethyl or β-hydroxyethyl.

Preferred substituents in the benzyl group X are for example: halogen atoms, nitro, methyl or methoxy groups. Examples of such araliphatic groups are p-methylbenzyl, o- or p-chlorobenzyl, o- or p-nitrobenzyl.

The N-substituent X is in particular benzyl or alkyl of 1 to 8 carbon atoms, for example n-octyl or primarily methyl or ethyl.

The rings A are preferably unsubstituted or they are substituted by halogen or lower alkoxy, for example by chlorine or methoxy.

Colour formers of the tetrahydroquinoline compounds of the formula (1) which are of practical importance have the formula

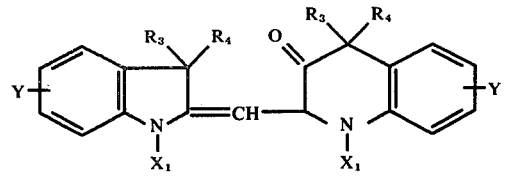

(2)

wherein each of $R_3$ and $R_4$ represents lower alkyl, chiefly methyl,

Y represents hydrogen, halogen or lower alkoxy, for example methoxy, and $X_1$ represents alkyl of 1 to 8 carbon atoms, preferably methyl or ethyl, or benzyl.

Halogen in connection with the above substituents in formulae (1) and (2) is to be understood as meaning for example fluorine, bromine or preferably chlorine.

Particularly useful colour formers in the colour-forming system of the recording material of the present invention are tetrahydroquinoline compounds of the formula

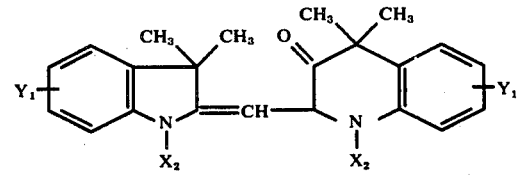

(3)

wherein $Y_1$ represents hydrogen or chlorine and $X_2$ represents methyl or ethyl.

The tetrahydroquinoline compounds of the formulae (1) to (3) are partly known compounds, yet constitute a new class of colour formers. They can be obtained by processes which are known per se. One process for obtaining the tetrahydroquinoline compounds of the general formula (1) comprises oxidising a 2-methylene-indoline compound of the formula

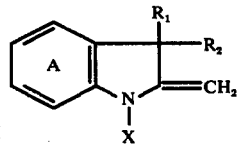

(4)

wherein A, $R_1$, $R_2$ and X are as previously defined herein, in the presence of an alkali metal carbonate or hydrogen carbonate, in particular of sodium hydrogen carbonate. A particularly suitable oxidant is potassium hexacyanoferrate (III).

The tetrahydroquinoline compounds of the formulae (1) to (3) are normally colourless or at most faintly coloured. When these colour formers are brought into contact with an acid developer, i.e. an electron acceptor, they produce yellow, orange or red tints of excellent light fastness. They are therefore also very useful when mixed with other known colour formers, for example crystal violet lactone, 3,3-(bis-aminophenyl)-phthalide, 3-(aminophenyl-3-indolyl)-phthalide, 2,6-diaminofluoranes or benzoyl leucomethylene blue, to produce blue, navy blue, grey or black colourations.

These colour formers are chiefly suitable for use in a pressure-sensitive recording material, which can also be a copying material. Such a material comprises for example at least one pair of sheets, which contain at least one colour former of the formulae (1) to (3) dissolved in an organic solvent and an electron acceptor substance as developer. The colour former effects a coloured marking at those points where it comes into contact with the electron acceptor substance.

Typical examples of such developers are attapulgite clay, silicon clay, silica, bentonite, halloysite, aluminium oxide, aluminium sulphate, aluminium phosphate, zinc chloride, kaolin or any clay or organic compounds with acid reaction, for example unsubstituted or ring-substituted phenols, salicylic acid or esters of salicylic acid and the metal salts thereof, or an acid polymeric material, for example a phenolic polymer, an alkylphenolacetylene resin, a maleic acid/rosin resin or a partially or completely hydrolysed polymer of maleic acid and styrene, ethylene, vinyl methyl ether or carboxypolymethylene. Preferred developers are attapulgite clay, silton clay or phenolformaldehyde resin. These electron acceptors are preferably applied in the form of a layer to the face of the receiver sheet.

In order to prevent the colour formers contained in the pressure-sensitive recording material from becoming active too soon, they are usually separated from the electron acceptor substance. This can advantageously be accomplished by incorporating the colour formers in foam-like, sponge-like or honeycomb-like structures. Preferably, however, the colour formers are enclosed in microcapsules, which as a rule can be ruptured by pressure.

When the capsules are ruptured by pressure, for example with a pencil, and the colour former solution is transferred in this manner to an adjacent sheet which is coated with an electron acceptor, a coloured area is produced. This colour results from the dye which is formed and which is absorbed in the visible range of the electromagnetic spectrum.

The colour formers are encapsulated preferably in the form of solutions in organic solvents. Examples of suitable solvents are preferably non-volatile solvents, for example polyhalogenated diphenyl, such as trichlorophenyl or a mixture thereof with liquid paraffin; tricresyl phosphate, di-n-butyl phthalate, dioctyl phthalate, trichlorobenzene, nitrobenzene, trichloroethyl phosphate, petroleum ether, hydrocarbon oils, such as paraffin, alkylated derivatives of naphthalene or diphenyl, terphenyls, partially hydrogenated terphenyl, or other chlorinated or hydrogenated condensed aromatic hydrocarbons. The capsule walls can be formed evenly around the droplets of the colour former solution by coacervation, and the encapsulating material can consist of gelatin and gum arabic, as described e.g. in U.S. Pat. No. 2,800,457.

The capsules can be formed preferably also from an aminoplast or from modified aminoplasts by polycondensation, as described in the British Pat. Nos. 989,264, 1,156,725, 1,301,052, 1,355,124 or 1,389,238.

The microcapsules containing the colour formers of formula (1) can be used for the manufacture of a wide variety of known kinds of pressure-sensitive copying material. The various systems differ substantially from one another in the arrangement of the capsules, the colour reactants and the carrier material.

A preferred arrangement is that in which the encapsulated colour former is applied as a layer to the back of a transfer sheet and the electron acceptor substance as a layer to the face of a receiving sheet. However the components can also be used in the paper pulp.

Another arrangement of the constituents consists in the microcapsules which contain the colour former, and the developer, being in or on the same sheet in the form of one or more individual sheets or being present in the paper pulp.

Such pressure-sensitive copying materials are described, for example, in U.S. Pat. Nos. 2,730,457, 2,932,582, 3,418,250, 3,418,656, 3,427,180 and 3,516,846. Further systems are described in British Pat. Nos. 1,042,596, 1,042,597, 1,042,598, 1,042,599, 1,053,935 and 1,517,650. Microcapsules which contain the colour formers of formula (1) are suitable for each of these systems and for other pressure-sensitive systems.

The capsules are preferably secured to the carrier by means of a suitable adhesive. Since paper is the preferred carrier material, these adhesives are principally paper coating agents, for example gum arabic, polyvinyl alcohol, hydroxymethyl cellulose, casein, methyl cellulose or dextrin.

The term "paper" used herein comprises not only normal paper made from cellulose fibres, but also paper in which the cellulose fibres are replaced (partially or completely) by synthetic polymer fibres.

The tetrahydroquinoline compounds of formulae (1) to (3) can also be used as colour formers in a thermoreactive recording material. This recording material contains normally at least one carrier, one colour former one electron acceptor substance and optionally one binder. Thermoreactive recording systems comprise heat sensitive recording and copying materials and papers. These systems are used, for example, for recording information, e.g. in electronic computers, teleprinters or telewriters, and in measuring instruments. The image (mark) formation can also be effected manually with a heated pen. Laser beams can also be used to produce heat-induced marks. The thermoreactive recording material can be so composed that the colour former is dispersed or dissolved in one binder layer and the developer is dissolved or dispersed in the binder in a second layer. A second possibility consists in dispersing both the colour former and the developer in the binder in one layer. By means of heat the binder is softened at specific areas and the colour former comes into contact with the electron acceptor substance at those points where heat is applied and the desired colour develops at once.

The developers are the same electron-accepting substances as are used in pressure-sensitive papers.

Examples of developers are the clays and phenolic resins already mentioned, or phenolic compounds, for example 4-tert. butylphenol, 4-phenylphenol, 4-hydroxydiphenyl oxide, $\alpha$-naphthol, $\beta$-naphthol, 4-hydroxymethyl benzoate, 4-hydroxyacetophenone, 2,2'-dihydroxydiphenyl, 4,4-isopropylidenediphenol, 4,4'-isopropylidene-bis-(2-methylphenol), 4,4'-bis-(hydroxyphenyl)valeric acid, hydroquinone, pyrogallol, phloroglucinol, p-, m- and o-hydroxybenzoic acid, gallic acid, 1-hydroxy-2-naphthoic acid, as well as boric acid and aliphatic dicarboxylic acids, for example tartaric acid, oxalic acid, maleic acid, citric acid, citraconic acid or succinic acid.

Fusible, film-forming binders are preferably used for the manufacture of the thermoreactive recording material. These binders are normally water-soluble, whereas the colour formers and the developer are insoluble in water. The binder should be able to disperse and fix the colour former and the developer at room temperature.

By applying heat the binder softens or melts, so that the colour former comes in contact with the developer and a colour is able to form. Examples of binders which are soluble or at least swellable in water are hydrophilic polymers, for example polyvinyl alcohol, polyacrylic acid, hydroxyethyl cellulose, methyl cellulose, carboxymethyl cellulose, polyacrylic amide, polyvinyl pyrrolidone, gelatin and starch.

If the colour former and the developer are in two separate layers, it is possible to use water-soluble binders, i.e. binders which are soluble in non-polar or only weakly polar solvents, for example natural rubber, synthetic rubber, chlorinated rubber, alkyl resins, polystyrene, styrene/butadiene copolymers, polymethylmethacrylates, ethyl cellulose, nitrocellulose and polyvinyl carbazole. The preferred arrangement, however, is that in which the colour former and the developer are contained in one layer in a water-soluble binder.

The thermoreactive coatings can contain further additives. To improve the degree of whiteness, to facilitate the printing of papers, and to prevent the heated pen from sticking, the coatings can contain, for example, talc, $TiO_2$, ZnO or $CaCO_3$ or also organic pigments, for example urea/formaldehyde polymers. In order to effect the colour formation only within a limited temperature range, it is possible to add substances such as urea, thiourea, acetanilide, phthalic anhydride or other appropriate fusible products which induce the simultaneous melting of the colour former and developer.

Typical thermoreactive recording materials in which the colour formers of formulae (1) to (3) can be used are described, for example, in German Offenlegungsschriften 2,110,864 and 2,228,581, in French Pat. No. 1,524,826 and in Swiss Pat. Nos. 164,976, 407,185, 444,196 and 444,197.

The following Examples illustrate the invention, the percentages being by weight unless otherwise stated.

MANUFACTURING DIRECTIONS

A. 66 g of potassium ferricyanide and 20 g of sodium hydrogen carbonate are dissolved in 160 ml of water. To this solution is added dropwise a solution of 17.3 g of 1,3,3-trimethyl-2-methylene-indoline in 240 ml of acetonitrile. The mixture is stirred for 16 hours at room temperature and then poured into 500 ml of water, whereupon a precipitate forms. The precipitate is collected by filtration, washed with water and dried to give 16.4 g of a powdery, orange product which has the formula

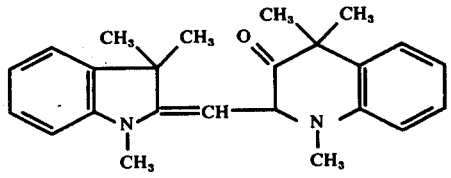

(11)

A sample recrystallised from ethanol has a melting point of 147°–148° C. This colour former develops on silton clay an orange shade of λ max. 478 nm.

B. The procedure of Manufacturing Direction A is repeated, substituting 20.7 g of 5-chloro-1,3,3-trimethyl-2-methylene-indoline for the 2-methylene-indoline compound, to yield 15.3 g of a compound of the formula

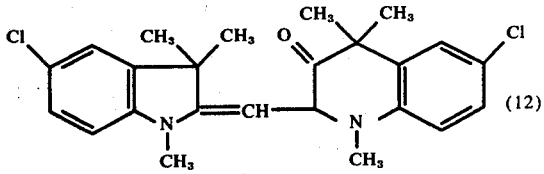

(12)

The melting point of a sample recrystallised from a mixture of n-propanol and ethyl acetate is 177°–179° C. This colour former develops an orange shade on silton clay with λ max. 483 nm.

EXAMPLE 1

Manufacture of a pressure-sensitive copying paper

A solution of 3 g of the tetrahydroquinoline compound of formula (11) in 97g of partially hydrogenated terphenyl is emulsified in a solution of 12 g of pigskin gelatin in 88 g of water of 50° C. A solution of 12 g of gum arabic in 88 g of 50° C is then added, followed by the addition of 200 ml of water of 50° C. The resultant emulsion is poured into 600 g of ice water and cooled until the temperature is 20° C, in the course of which the coacervation is effected. A sheet of paper is coated with the resultant suspension of microcapsules and dried. A second sheet of paper is coated with silton clay. The first sheet and the sheet of paper coated with silton clay are laid on top of each other with the coated sides face to face.

Pressure is exerted by writing by hand or typewriter and an orange copy of excellent lightfastness develops on the sheet which is coated with clay.

A corresponding orange effect is attained by using the colour former of the formula (12).

EXAMPLE 2

Manufacture of a thermoreactive paper 6 g of an aqueous dispersion which contains 1.57% of the tetrahydroquinoline compound of formula (12) and 6.7% of polyvinyl alcohol are mixed with 134 g of an aqueous dispersion which contains 14% of 4,4-isopropylidene-diphenol, 8% of attapulgite clay and 6% of polyvinyl alcohol. This mixture is applied to a paper and dried. Contacting the paper with a heated ballpoint pen produces a vivid orange colour of excellent lightfastness. A similar result is obtained by using the colour former of formula (11) obtained in Manufacturing Direction A.

I claim:

1. A pressure-sensitive or heat-sensitive recording material which contains as colour former at least one tetrahydroquinoline compound of the formula

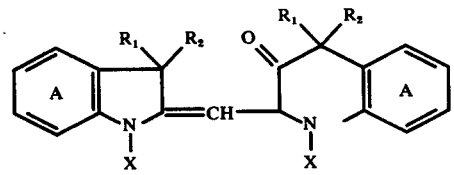

(1)

wherein each of $R_1$ and $R_2$ represents lower alkyl, cycloalkyl or benzyl or together represent alkylene, and X represents alkyl of at most 12 carbon atoms which is unsubstituted or substituted by halogen, hydroxyl, cyano, lower alkoxy or lower alkoxycarbonyl, or benzyl which is unsubstituted or substituted by halogen, nitro, lower alkyl or lower alkoxy, and the rings A are unsubstituted or substituted by halogen, nitro, cyano, trifluoromethyl, lower alkyl, lower alkoxy, lower alkoxycarbonyl, phenyloxy, amino, lower alkylamino or N-lower alkylcarbonylamino.

2. A recording material according to claim 1, wherein the colour former is a tetrahydroquinoline compound of the formula (1), wherein each of $R_1$ and $R_2$ represents lower alkyl.

3. A recording material according to claim 1, wherein the colour former is a tetrahydroquinoline compound of the formula (1), wherein X represents alkyl of 1 to 8 carbon atoms or benzyl.

4. A recording material according to claim 1, wherein the colour former is a tetrahydroquinoline compound of the formula (1), wherein the rings A are unsubstituted or substituted by halogen or lower alkoxy.

5. A recording material according to claim 1, wherein the colour former is a tetrahydroquinoline compound of the formula

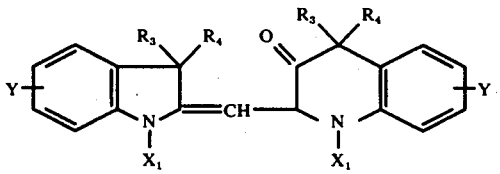

(2)

wherein each of $R_3$ and $R_4$ represents lower alkyl,

Y represents hydrogen, halogen or lower alkoxy, and $X_1$ represents alkyl of 1 to 8 carbon atoms or benzyl.

6. A recording material according to claim 5, wherein the colour former is a tetrahydroquinoline compound of the formula (2), wherein each of $R_3$ and $R_4$ represents methyl and $X_1$ represents methyl, ethyl or benzyl.

7. A recording material according to claim 1, wherein the colour former is a tetrahydroquinoline compound of the formula

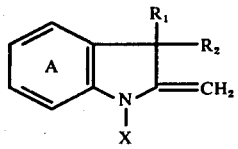

(4)

wherein $Y_1$ represents hydrogen or chlorine and $X_2$ represents methyl or ethyl.

8. A recording material according to claim 1 which is pressure-sensitive.

9. A pressure-sensitive recording material according to claim 8, which contains at least one tetrahydroquinoline compound of claim 1 as colour former, dissolved in an organic solvent, and an electron acceptor substance.

10. A pressure-sensitive recording material according to claim 9, wherein the solution of the tetrahydroquinoline compound in an organic solvent is contained in microcapsules.

11. A pressure-sensitive recording material according to claim 9, wherein the electron acceptor substance is attapulgite clay, silton clay, or a phenolformaldehyde resin.

12. A pressure-sensitive recording material according to claim 10, wherein the encapsulated tetrahydroquinoline compound is applied in the form of a layer to the reverse side of a transfer sheet and the electron acceptor substance is applied in the form of a layer to the face of the receiver sheet.

13. A pressure-sensitive recording material according to claim 8, which contains the tetrahydroquinoline compound together with one or more other colour formers.

14. A heat-sensitive recording material according to claim 1 which contains in at least one layer at least one colour former, one electron acceptor and one binder, wherein the colour former has the formula of claim 1.

15. A heat-sensitive recording material according to claim 14, wherein the colour developer is attapulgite clay, silton clay, a phenolic compound, a phenolic resin or a solid organic acid.

* * * * *

UNITED STATES PATENT OFFICE
CERTIFICATE OF CORRECTION

PATENT NO. : 4,025,090
DATED : May 24, 1977
INVENTOR(S) : JEAN-CLAUDE PETITPIERRE

It is certified that error appears in the above-identified patent and that said Letters Patent are hereby corrected as shown below:

Col. 8, the entire top formula should be deleted and substituted with the following --

---

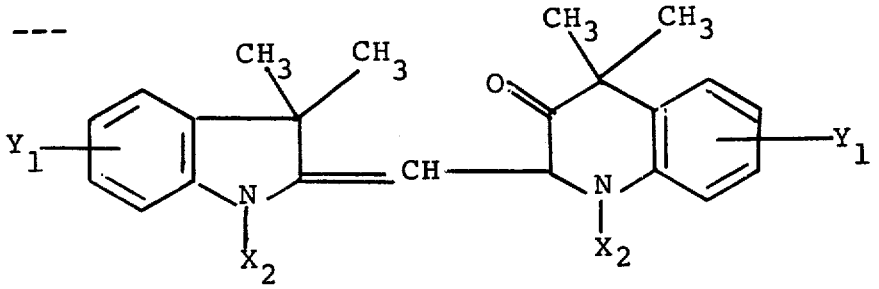

(3)

--

Signed and Sealed this
ninth Day of August 1977

[SEAL]

*Attest:*

RUTH C. MASON
*Attesting Officer*

C. MARSHALL DANN
*Commissioner of Patents and Trademark*